US005961867A

United States Patent [19]

McWilliams

[11] Patent Number: 5,961,867

[45] Date of Patent: Oct. 5, 1999

[54] METHOD AND APPARATUS FOR CONTROLLING AN ELECTRIC HEATER

[75] Inventor: Kevin Ronald McWilliams, Stratford-upon-Avon, United Kingdom

[73] Assignee: Ceramaspeed Limited, United Kingdom

[21] Appl. No.: 09/071,023

[22] Filed: May 1, 1998

[30] Foreign Application Priority Data

May 22, 1997 [GB] United Kingdom ..... 9710429

[51] Int. Cl.[6] ..... H05B 3/68

[52] U.S. Cl. ..... 219/446.1; 219/448.19

[58] Field of Search ..... 219/446.1, 448.11, 219/448.12, 448.14, 448.15, 448.16, 448.17, 448.18, 448.19, 457.1, 460.1, 465.1

[56] References Cited

U.S. PATENT DOCUMENTS

| | | | |
|---|---|---|---|
| 4,447,710 | 5/1984 | McWilliams | 219/448.19 |
| 5,001,329 | 3/1991 | Shimomura et al. | 219/448.19 |
| 5,113,170 | 5/1992 | Goessler et al. | 219/448.19 |
| 5,310,993 | 5/1994 | McWilliams et al. | 219/448.19 |
| 5,420,398 | 5/1995 | Petri et al. | 219/448.19 |
| 5,489,764 | 2/1996 | Mannuss et al. | 219/448.19 |

FOREIGN PATENT DOCUMENTS

| | | |
|---|---|---|
| 1514736 | 6/1978 | United Kingdom . |
| 2199999 | 7/1988 | United Kingdom . |
| 2212303 | 7/1989 | United Kingdom . |

OTHER PUBLICATIONS

Search Report Jul. 30, 1997.

*Primary Examiner*—Teresa Walberg
*Assistant Examiner*—Sam Paik
*Attorney, Agent, or Firm*—Ira S. Dorman

[57] ABSTRACT

An electric heater (1) arranged beneath a glass-ceramic cook top (2) is controlled with the aid of a temperature sensor (7) for monitoring temperature at or adjacent to the glass-ceramic cook top. The sensor provides an electrical output as a function of temperature and permits monitoring, in time controlled manner, temperature at or adjacent to the glass-ceramic cook top. In a first stage the temperature of the glass-ceramic cook top (2) is permitted to exceed a predetermined continuous safe level (Y) for up to a predetermined maximum time period (X, $W_2$, W) and such that a predetermined temporary safe level (Z) of temperature, in excess of the predetermined continuous safe level (Y), is not exceeded. In a second stage the heater (1) is regulated in accordance with the monitored temperature to achieve a selected temperature of the glass-ceramic cook top in a range up to the predetermined continuous safe level (Y) of temperature.

38 Claims, 2 Drawing Sheets

METHOD AND APPARATUS FOR CONTROLLING AN ELECTRIC HEATER

This invention concerns a method and apparatus for controlling an electric heater arranged beneath a glass-ceramic cook top in a cooking appliance. More particularly, the invention is concerned with a control method and apparatus for such a heater which adapts to different requirements between an initial stage of operation of the heater and a subsequent longer term equilibrium stage of operation and results in faster heating to boiling on the cook top.

DESCRIPTION OF PRIOR ART

As is well known, heaters used in glass-ceramic top cooking appliances usually incorporate a temperature limiter which operates to maintain the temperature of the glass-ceramic within safe limits. Such a temperature limiter generally comprises a differentially expanding rod and tube assembly arranged at least partly across the heater between a heating element in the heater and the glass-ceramic top and operating a switch arrangement located outside the heater.

Temperature limiters of this kind are typically calibrated in accordance with worst case steady state conditions to be encountered, namely free radiation of the heater under the glass-ceramic cook top, that is in the absence of a cooking utensil on the cook top. Since the calibration of the temperature limiter is fixed, the switching condition is, of necessity, a compromise. In order to ensure safe steady state conditions of operation of an appliance, the switching response has to be set at such a level that so-called nuisance switching off and on of the heater occurs during the initial heating stage. Such undesirable repetitive switching of the heater disadvantageously increases the boiling time of the contents of a cooking utensil on the cook top and is especially problematical with poor quality cooking utensils, or large volumes of materials to be cooked, or with heaters of high power. In fact, increasing the power of a heater can fail to result in faster boiling times since the nuisance switching effect increases in proportion to increasing power and counteracts the intended benefit to be derived from an increase in heater power.

The function of a temperature limiter is to restrict the temperature reached by the glass-ceramic to a safe level, that is a predetermined level at which the glass-ceramic may be continuously operated, and this predetermined level is hereinafter referred to as the predetermined continuous safe temperature level. However, a higher temperature level is acceptable for the glass-ceramic without significantly reducing the life thereof, provided such higher temperature level is experienced for a short period of time only. Such short term higher temperature level is hereinafter referred to as the predetermined temporary safe level of temperature, being permitted for a predetermined maximum time period.

Attempts have been made to arrange for such a higher temperature level to be attained in an initial heating stage by delaying the response of the temperature limiter by means which temporarily shield the temperature limiter from incident thermal radiation. However, this effect predominantly only occurs at the first switching of the temperature limiter and is not accurately controllable.

A further factor to be considered is that when a heating element in a heater is energised, thermal gradients occur therein and these are significantly different when the element is initially switched on, compared with the element when heated to equilibrium conditions. This is particularly significant for temperature sensing if the sensor is not directly coupled to the glass-ceramic and leads to a different relationship between sensor temperature and glassceramic temperature during the initial stages of operation of a heater as compared with long term operation under equilibrium conditions.

United Kingdom Patent Specification No. 1,514,736 describes the control of electrically heated hot plates of cast iron or other suitable metal where the problems addressed by the present invention do not arise. According to UK Patent Specification No. 1,514,736 a cooking vessel is permitted to attain an initial temperature which is higher than under steady state operation. The duration of the initial temperature boost and the effect thereof on the hot plate are not considered.

United Kingdom Patent Publication No. 2,199,999 describes a temperature limiting arrangement for a glass-ceramic cooktop appliance in order to provide protection against overheating of the glass-ceramic cooktop. It is acknowledged there is a need for a means of limiting the temperature of the glass-ceramic plate which satisfactorily protects the glass-ceramic from overheating while minimizing any adverse effect on cooking performance and heating unit longevity. This is accomplished by monitoring the glass-ceramic temperature and the temperature rate of change to detect an abnormal thermal load condition such as operating the heating unit with no utensil on the cooktop surface, using badly warped surfaces and operating the heating unit with an empty utensil. The power level is then reduced to limit the temperature of the glass-ceramic cooking surface so as to avoid damage.

United Kingdom Patent Publication No. 2,212,303 describes a power control for a cooking appliance having a glass-ceramic cooking surface. A temperature sensor is provided for sensing the temperature of the glass-ceramic cooking surface and the power level of a heating unit is responsive to the sensed temperature.

OBJECT OF THE INVENTION

It is an object of the present invention to provide a temperature sensing and heater control system which is adaptive to the differences between the initial operating conditions and longer term equilibrium conditions of a heater in a glass-ceramic top cooking appliance.

SUMMARY OF THE INVENTION

According to one aspect of the present invention there is provided a method of providing electronic control of an electric heater arranged beneath a glass-ceramic cook top, which method comprises providing a temperature sensor for monitoring temperature in the region of (that is, at or adjacent to) the glass-ceramic cook top, which sensor provides an electrical output as a function of temperature and monitoring by means of the sensor, in time controlled manner, temperature in the region of the glass-ceramic cook top, wherein in a first stage the temperature of the glass-ceramic cook top is permitted to exceed a predetermined continuous safe level for up to a predetermined maximum time period and such that a predetermined temporary safe level of temperature, in excess of the predetermined continuous safe level, is not exceeded and wherein in a second stage the heater is regulated in accordance with the monitored temperature to achieve a selected temperature of the glass-ceramic cook top in a range up to the predetermined continuous safe level of temperature.

According to another aspect of the present invention there is provided an apparatus for providing electronic control of an electric heater arranged beneath a glass-ceramic cook top, which apparatus comprises a temperature sensor for monitoring temperature in the region of (that is, at or adjacent to) the glass-ceramic cook top, which sensor provides an electrical output as a function of temperature, and means to monitor by the sensor, in time controlled manner, temperature in the region of the glass-ceramic cook top, wherein means is provided operating in a first stage to permit the temperature of the glass-ceramic cook top to exceed a predetermined continuous safe level for up to a predetermined maximum time period and such that a predetermined temporary safe level of temperature, in excess of the predetermined continuous safe level, is not exceeded, and wherein means is provided operating in a second stage to regulate the heater in accordance with the monitored temperature, to achieve a selected temperature of the glass-ceramic cook top in a range up to the predetermined continuous safe level of temperature.

In the first stage, the temperature in the region of the glass-ceramic cook top may be monitored only after elapse of a predetermined time period, which may be the predetermined maximum time period.

Alternatively, in the first stage the temperature in the region of the glass-ceramic cook top may be substantially continuously monitored and the heater regulated in accordance with the monitored temperature such that the predetermined temporary safe level of temperature is not exceeded.

The rate of rise of temperature in the first stage may be monitored and compared with a specific rate of rise on the basis of which the predetermined maximum time period and/or the predetermined temporary safe level of temperature have been established, and the predetermined maximum time period and/or the predetermined temporary safe level of temperature may be adjusted proportionate to the compared rate of rise and specific rate of rise of temperature.

The temperature sensor may comprise a device having an electrical parameter, such as electrical resistance, inductance, or capacitance, which changes as a function of temperature. By way of example, such a device may comprise a platinum resistance temperature detector.

Alternatively the temperature sensor may comprise a thermoelectric device, such as a thermocouple, producing an electrical output as a function of temperature.

The temperature sensor may be located in the heater between a heating element in the heater and the glass-ceramic cook top, or in contact with the glass-ceramic cook top.

The temperature sensor may be located inside a heat-withstanding housing, optionally of tubular form, such as of a metal or alloy. A suitable alloy is a stainless steel or an iron-chromium-aluminium alloy.

The temperature sensor may be electrically connected to a microprocessor-based control system whereby the temperature in the region of the glass-ceramic cook top is monitored in time controlled manner and the heater regulated in accordance with the predetermined temporary safe level of temperature and the predetermined continuous safe level of temperature.

Regulation of power to the heater may be effected by way of a relay, or a solid state switch means.

A user-settable power control means may additionally be provided for the heater. Such control means may comprise a manually adjustable cyclic energy regulator or a multiple-position switch arrangement.

The invention is now described by way of example with reference to the accompanying drawings in which:

DESCRIPTION OF PREFERRED EMBODIMENT

Figure 1:
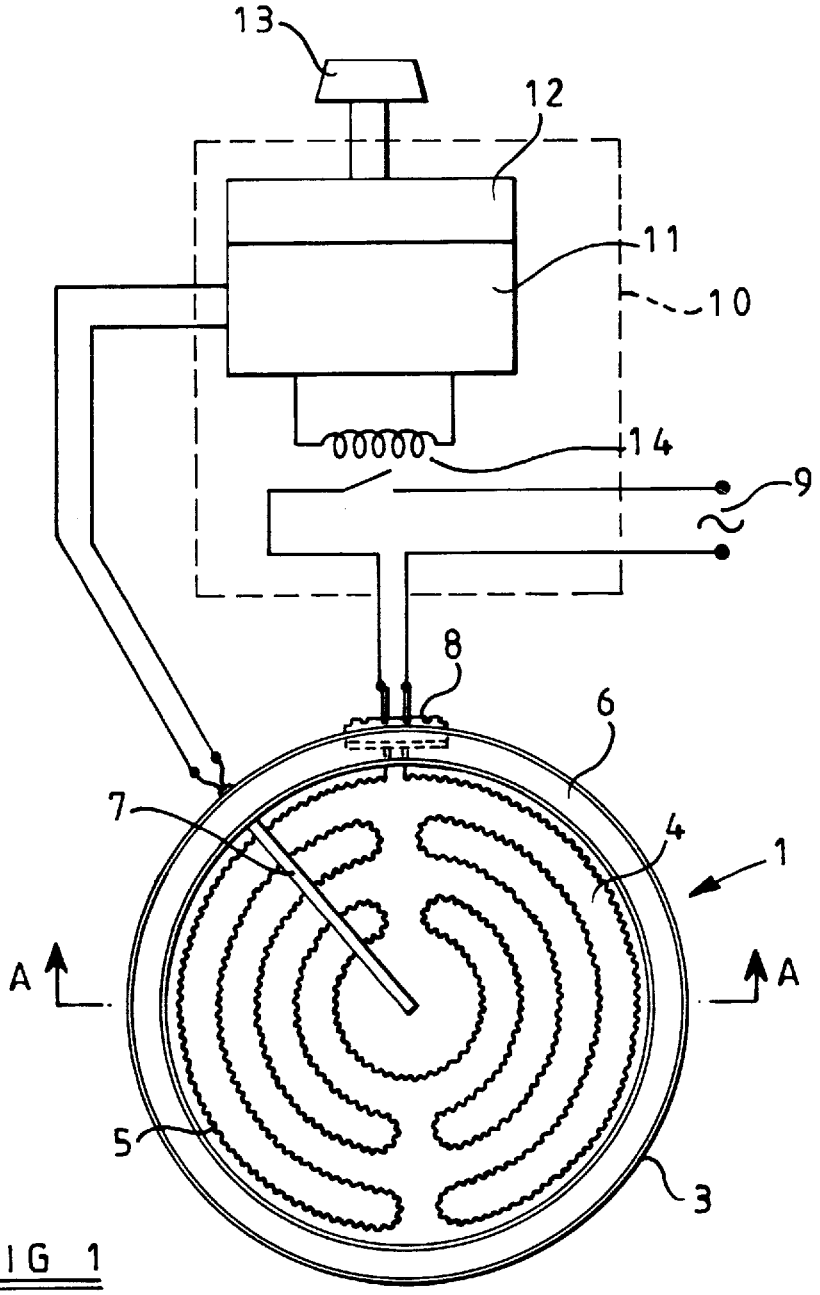
FIG. 1 is a plan view of an electric heater connected to an electronic controller according to the present invention, the electronic controller being represented diagrammatically.
Figure 2:
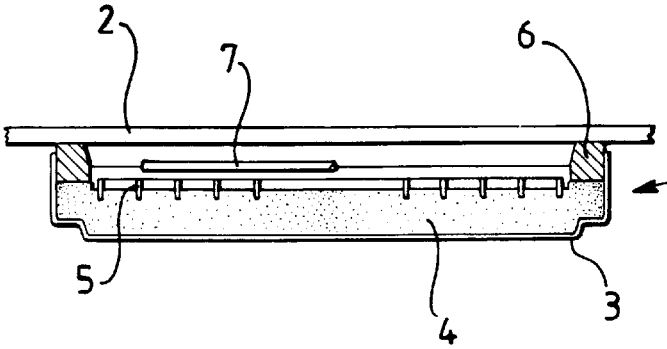
FIG. 2 is a section along line A—A of the heater of FIG. 1 arranged beneath a glass-ceramic cook top.

Referring to FIGS. 1 and 2, an electric heater 1 is provided arranged beneath a glass-ceramic cook top 2 in a cooking appliance, such as a smooth top cooker. The heater 1 comprises a metal dish 3 having therein a base layer 4 of compacted microporous thermal insulation material.

A heating element 5 is provided, supported on the base layer 4. As shown, the heating element 5 comprises a corrugated metal ribbon supported edgewise on the base layer 4 and secured by partial embedding in the base layer 4. However, the heating element 5 could comprise other forms, such as coiled wire or coiled ribbon or other arrangements of ribbon, or one or more infra-red lamps. Any of the well-known forms of heating element, or combinations thereof, could be considered, the invention not being restricted to any particular form of heating element.

A peripheral wall 6 of thermal insulation material is provided, a top surface of which contacts the underside of the glass-ceramic cook top 2.

A temperature sensor 7 is arranged to extend partially across the heater, between the heating element 5 and the glass-ceramic cook top 2. The temperature sensor 7 comprises a tube, such as of metal, having therein a device which provides an electrical output as a function of temperature. The tube may, for example, comprise a stainless steel or iron-chromium-aluminium alloy. The device may have an electrical parameter, such as electrical resistance or inductance, which changes as a function of temperature. In particular, the device may comprise a platinum resistance temperature detector or thermometer. Alternatively the device in the temperature sensor 7 could comprise a thermoelectric device, such as a thermocouple, producing an electrical output, such as a voltage output, as a function of temperature.

As an alternative, a temperature sensor could be provided secured in contact with the glass-ceramic cook top 2.

A terminal block 8 is provided at the edge of the heater and by means of which the heating element 5 is arranged to be electrically connected to a power supply 9 for energisation.

Control circuitry 10 is provided for the heater 1. Such control circuitry comprises a microcontroller 11, which is a microprocessor-based circuit. A cyclic energy regulator 12 is also provided, which has a control knob 13 by means of which a plurality of user-selectable energy settings of the heater can be achieved in known manner.

Power is supplied to the heater from the power supply 9 by way of a relay 14, or by way of a solid state switch means, such as a triac, transistor, FET, IGBT, or SCR.

The temperature at or adjacent to the glass-ceramic cook top 2 is monitored in time controlled manner by means of the temperature sensor 7 in association with the microcontroller 11, to which the sensor 7 is connected.

The glass-ceramic cook top 2 may be operated continuously without damage at a predetermined temperature level which is herein referred to as the predetermined continuous safe level of temperature. However, in a first, or initial, stage, in order to achieve the fastest possible boiling time for a food item in a cooking utensil located on the glass-ceramic cook top 2, the predetermined continuous safe level of temperature may be temporarily exceeded for a short period of time with safety. The glass-ceramic cook top may therefore be operated at a predetermined temporary safe level of temperature, in excess of the predetermined continuous safe level of temperature, for up to a predetermined maximum time period.

The predetermined temporary safe level of temperature and maximum time period can be obtained for each heating element, dependent on such factors as power loading, and such that under so-called abuse conditions, where the heater is operated under free radiation conditions without the presence of a cooking utensil on the glass-ceramic cook top, the glass-ceramic is permitted to reach a higher temperature than the predetermined continuous safe level of temperature permitted under equilibrium operating conditions of the heater.

Figure 3:
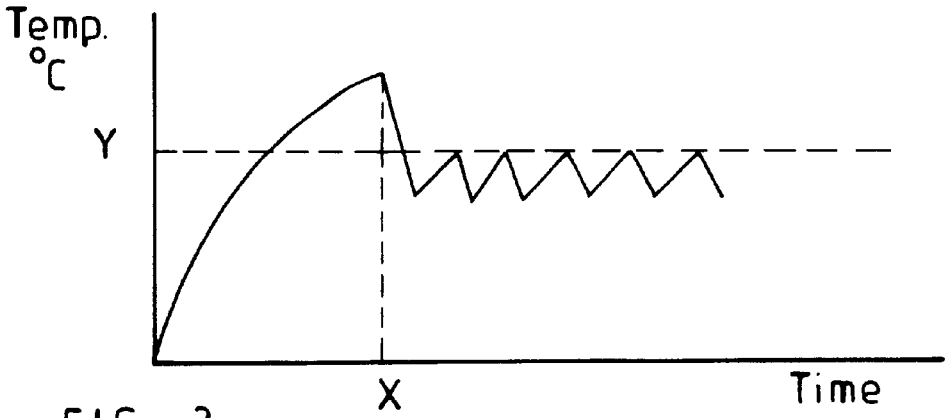
FIGS. 3 to 5 are graphs illustrating control and regulation of glass-ceramic cook top temperature with time.

One method of control according to the invention is illustrated in FIG. 3.

When the cooking appliance is operated, the temperature of the glass-ceramic is monitored by the temperature sensor 7 and microcontroller 11 but in the first stage only after a time period X, such as 10 minutes, has elapsed. Such time period X may be the predetermined maximum time period, referred to above, as determined for the particular heater. The monitored temperature after the time period X is in excess of the predetermined continuous safe level Y. Consequently the microcontroller 11 adapts the power input to the heater 1, on the basis of this monitored temperature, such that in a second stage of operation of the appliance, subsequent to the initial time period X, the heater operates in equilibrium conditions such that the predetermined continuous safe level Y of temperature for the glass-ceramic cook top 2 is not exceeded.

Figure 4:
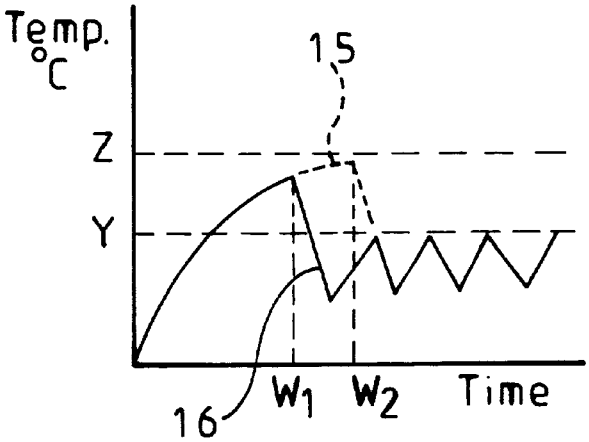
Figure 5:
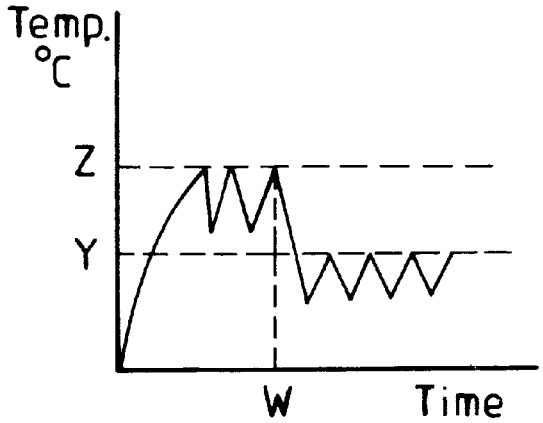

In another method of control, as illustrated in FIGS. 4 and 5, the temperature at or adjacent to the glass-ceramic cook top 2 is substantially continuously monitored by the temperature sensor 7 in association with the microcontroller 11. If, after a predetermined initial time period $W_1$ (less than the predetermined maximum time period) has elapsed, the monitored temperature has not reached the predetermined temporary safe level Z of temperature, the heater may be allowed to continue to operate without further control for a further period, as indicated by the dotted trace 15 until, at time period $W_2$, representing the predetermined maximum time period, the microcontroller 11 adapts the power input to the heater such that in a second stage of operation the heater operates in equilibrium conditions such that the predetermined continuous safe level Y of temperature is not exceeded. Alternatively, after the predetermined initial time period $W_1$ has elapsed, the power input to the heater could be adapted, as shown by the continuous trace 16, such that after $W_1$ the heater is operated in equilibrium conditions whereby the predetermined continuous safe level Y of temperature is not exceeded.

With reference now to FIG. 5, a situation can arise where during the initial or first stage of heating the monitored temperature reaches the predetermined temporary safe level Z. When this occurs, the microcontroller 11 adapts the power input to the heater so that up to the predetermined maximum time period W the predetermined temporary safe level Z of temperature is not exceeded. Thereafter, in the second stage of operation, the microcontroller further adapts the power input to the heater such that the predetermined continuous safe level Y of temperature for the glass-ceramic cook top 2 is not exceeded.

In situations where the monitored temperature in the first stage rises at a slower or faster rate than predicted, the predetermined maximum time period and/or the predetermined temporary safe level of temperature can be arranged to be automatically adjusted such that a higher temperature for a shorter period of time or a lower temperature for a longer period of time is permitted. The rate of rise of temperature in the first stage is monitored and compared with a specific rate of rise on the basis of which the predetermined maximum time period and the predetermined temporary safe level of temperature have been established. The predetermined temporary safe level of temperature and/or the predetermined maximum time period may then be adjusted in proportion to the compared rates of rise of temperature.

Instead of the cyclic energy regulator 12, a well known form of multiple position switch control arrangement (not shown) could be provided to control the heater 1.

I claim:

1. A method of providing electronic control of an electric heater arranged beneath a glass-ceramic cook top, which method comprises providing a temperature sensor for monitoring temperature in the region of the glass-ceramic cook top, which sensor provides an electrical output as a function of temperature and monitoring by means of the sensor, in time controlled manner, temperature in the region of the glass-ceramic cook top, wherein in a first stage the temperature of the glass-ceramic cook top is permitted to exceed a predetermined continuous safe level for up to a predetermined maximum time period and such that a predetermined temporary safe level of temperature, in excess of the predetermined continuous safe level, is not exceeded and wherein in a second stage the heater is regulated in accordance with the monitored temperature to achieve a selected temperature of the glass-ceramic cook top in a range up to the predetermined continuous safe level of temperature.

2. A method according to claim 1, wherein in the first stage the temperature in the region of the glass-ceramic cook top is monitored only after elapse of a predetermined time period.

3. A method according to claim 2, wherein the temperature in the region of the glass-ceramic cook-top is monitored only after the predetermined maximum time period.

4. A method according to claim 1, wherein in the first stage the temperature in the region of the glass-ceramic cook top is substantially continuously monitored and the heater regulated in accordance with the monitored temperature such that the predetermined temporary safe level of temperature is not exceeded.

5. A method according to claim 1, wherein the rate of rise of temperature in the first stage is monitored and compared with a specific rate of rise on the basis of which at least one of the predetermined maximum time period and the predetermined temporary safe level of temperature have been established, and at least one of the predetermined maximum time period and the predetermined temporary safe level of temperature is adjusted proportionate to the compared rate of rise and specific rate of rise of temperature.

6. A method according to claim 1, wherein the temperature sensor comprises a device having an electrical parameter which changes as a function of temperature.

7. A method according to claim 6, wherein the electrical parameter of the device which changes as a function of temperature is selected from electrical resistance, inductance and capacitance.

8. A method according to claim 7, wherein the device comprises a platinum resistance temperature detector.

9. A method according to claim 6, wherein the temperature sensor comprises a thermoelectric device producing an electrical output as a function of temperature.

10. A method according to claim 9, wherein the thermoelectric device comprises a thermocouple.

11. A method according to claim 1, wherein the temperature sensor is located in the heater in a position selected from between a heating element in the heater and the glass-ceramic cook top and in contact with the glass-ceramic cook top.

12. A method according claim 11, wherein the temperature sensor is located inside a heat-withstanding housing.

13. A method according to claim 12, wherein the housing is of tubular form.

14. A method according to claim 13, wherein the housing is made of a material selected from a metal and an alloy.

15. A method according to claim 14, wherein the alloy is selected from a stainless steel and an iron-chromium-aluminium alloy.

16. A method according to claim 1, wherein the temperature sensor is electrically connected to a microprocessor-based control system whereby the temperature in the region of the glass-ceramic cook top is monitored in time controlled manner and the heater regulated in accordance with the predetermined temporary safe level of temperature and the predetermined continuous safe level of temperature.

17. A method according to claim 1, wherein regulation of power to the heater is effected by way of means selected from a relay and a solid state switch means.

18. A method according to claim 1, wherein a user-settable power control means is additionally provided for the heater.

19. A method according to claim 18, wherein the user-settable power control means is selected from a manually-adjustable cyclic energy regulator and a multiple-position switch arrangement.

20. Apparatus for providing electronic control of an electric heater arranged beneath a glass-ceramic cook top, which apparatus comprises a temperature sensor for monitoring temperature in the region of the glass-ceramic cook top, which sensor provides an electrical output as a function of temperature, and means to monitor by the sensor, in time controlled manner, temperature in the region of the glass-ceramic cook top wherein means is provided operating in a first stage to permit the temperature of the glass-ceramic cook top to exceed a predetermined continuous safe level for up to a predetermined maximum time period and such that a predetermined temporary safe level of temperature, in excess of the predetermined continuous safe level, is not exceeded, and wherein means is provided operating in a second stage to regulate the heater in accordance with the monitored temperature, to achieve a selected temperature of the glass-ceramic cook top in a range up to the predetermined continuous safe level of temperature.

21. Apparatus according to claim 20, wherein during operation in the first stage the temperature in the region of the glass-ceramic cook top is monitored only after elapse of a predetermined time period.

22. Apparatus according to claim 21, wherein the temperature in the region of the glass-ceramic cook-top is monitored only after the predetermined maximum time period.

23. Apparatus according to claim 20, wherein during operation in the first stage the temperature in the region of the glass-ceramic cook top is substantially continuously monitored, means being provided to regulate the heater in accordance with the monitored temperature such that the predetermined temporary safe level of temperature is not exceeded.

24. Apparatus according to claim 20, wherein the apparatus is adapted to monitor the rate of rise of temperature in the first stage and compare such rate with a specific rate of rise on the basis of which at least one of the predetermined maximum time period and the predetermined temporary safe level of temperature have been established, and to adjust at least one of the predetermined maximum time period and the predetermined temporary safe level of temperature proportionate to the compared rate of rise and specific rate of rise of temperature.

25. Apparatus according to claim 20, wherein the temperature sensor comprises a device having an electrical parameter which changes as a function of temperature.

26. Apparatus according to claim 25, wherein the electrical parameter of the device which changes as a function of temperature is selected from electrical resistance, inductance and capacitance.

27. Apparatus according to claim 26, wherein the device comprises a platinum resistance temperature detector.

28. Apparatus according to claim 25, wherein the temperature sensor comprises a thermoelectric device producing an electrical output as a function of temperature.

29. Apparatus according to claim 28, wherein the thermoelectric device comprises a thermocouple.

30. Apparatus according to claim 20, wherein the temperature sensor is located in the heater in a position selected from between a heating element in the heater and the glass-ceramic cook top and in contact with the glass-ceramic cook top.

31. Apparatus according to claim 30, wherein the temperature sensor is located inside a heat-withstanding housing.

32. Apparatus according to claim 31, wherein the housing is of tubular form.

33. Apparatus according to claim 32, wherein the housing is made of a material selected from a metal and an alloy.

34. Apparatus according to claim 33, wherein the alloy is is selected from a stainless steel and an iron-chromium-aluminium alloy.

35. Apparatus according to claim 20, wherein the temperature sensor is electrically connected to a microprocessor-based control system whereby the temperature in the region of the glass-ceramic cook top is monitored in time controlled manner and the heater regulated in accordance with the predetermined temporary safe level of temperature and the predetermined continuous safe level of temperature.

36. Apparatus according to claim 20, wherein regulation of power to the heater is effected by way of means selected from a relay and a solid state switch means.

37. Apparatus according to claim 20, wherein a user-settable power control means is additionally provided for the heater.

38. Apparatus according to claim 37, wherein the user-settable power control means is selected from a manually-adjustable cyclic energy regulator and a multiple-position switch arrangement.

* * * * *